US006179639B1

(12) United States Patent
Kuwahara et al.

(10) Patent No.: US 6,179,639 B1
(45) Date of Patent: Jan. 30, 2001

(54) ELECTRICAL CONNECTOR WITH A RESILIENTLY EXPANSIBLE LOCKING ELEMENT

(75) Inventors: Masanori Kuwahara; Makoto Higashikozono, both of Yokkaichi (JP)

(73) Assignee: Sumitomo Wiring Systems, Ltd., Mie (JP)

( * ) Notice: Under 35 U.S.C. 154(b), the term of this patent shall be extended for 0 days.

(21) Appl. No.: 09/352,954

(22) Filed: Jul. 14, 1999

(30) Foreign Application Priority Data

Jul. 16, 1998 (JP) ..... 10-202196

(51) Int. Cl.[7] ..... H01R 13/52
(52) U.S. Cl. ..... 439/282
(58) Field of Search ..... 439/350, 353, 439/282

(56) References Cited

U.S. PATENT DOCUMENTS 2,877,437 * 3/1959 Flanagan, Jr. ..... 439/353
3,594,696 * 7/1971 Witek, Jr. et al. ..... 439/353
3,976,347 * 8/1976 Cooke, Sr. et al. ..... 439/350
4,284,312 8/1981 Patchett et al. .
4,768,970 9/1988 Nestor .
4,872,736 * 10/1989 Myers et al. ..... 439/350
4,915,642 * 4/1990 Lin et al. ..... 439/350
5,176,533 * 1/1993 Sakurai et al. ..... 439/350
5,368,954 * 11/1994 Bruns ..... 429/97
5,746,619 * 5/1998 Harting et al. ..... 439/353
6,010,352 * 1/2000 Kameyama ..... 439/350

* cited by examiner

*Primary Examiner*—Khiem Nguyen
*Assistant Examiner*—Hae Moon Hyeon
(74) *Attorney, Agent, or Firm*—Oliff & Berridge, PLC

(57) ABSTRACT

An electrical connector has housings that have male and female fitting parts containing electrical terminals. The fitting parts have respective locking elements which interengage to restrain disconnection. The female fitting part has a front portion which is elastically expanded on engagement with the relatively rigid male fitting part, and a second portion rearwardly of the portion which is less elastic than the front portion. The electrical connector may, for example, be used with solar panels.

15 Claims, 9 Drawing Sheets

ELECTRICAL CONNECTOR WITH A RESILIENTLY EXPANSIBLE LOCKING ELEMENT

BACKGROUND OF THE INVENTION

1. Field of Invention

This invention relates to an electrical connector.

2. Description of Related Art

A solar panel for use in a solar-energy power generation system is constructed of a plurality of modules connected one with another in series. A specific connector is used for an electric connection of the modules.

A known connector of this kind and its defects will now be described. As shown in FIG. 7, a single pole connector of this kind is constructed of a plug-side connector member C1 having a cylindrical housing 1 accommodating a plug terminal 2 which is a male terminal, and a socket-side connector member C2 having a cylindrical housing 3 accommodating a socket terminal 4 which is a female terminal.

A female fitting part 5 is provided at the front side of the housing 1 of the connector member C1, and a hollow sleeve-shaped male fitting part 6 is provided at the front side of the housing 3 of the connector member C2. As shown in FIG. 8, the plug terminal 2 and the socket terminal 4 are electrically connected with each other by fitting the male fitting part 6 into the female fitting part 5. Reference symbols W1 and W2 denote electric wires connected to the terminals and extending from the connector members C1 and C2, respectively.

An outer peripheral surface 6*a* of the male fitting part 6 is tapered towards its front end to facilitate insertion into the female fitting part 5.

In this known connector, the entire housing 1 of the plug-side connector member C1 including the female fitting part 5 and the entire housing 3 of the socket-side connector member C2 including the male fitting part 6 are formed of the same plastic material, such as PVC. PVC is comparatively hard and has a low degree of elasticity. Thus, the fitting parts 5 and 6 are hard, and have mechanical properties such that they are difficult to elastically deform.

Thus, it is difficult to obtain a mechanical effect such that the fitting resistance of the fitting parts 5 and 6 is low when they are being fitted together, while their removal or disconnection resistance is high after they are fitted together. That is to say, when a construction in which the male fitting part 6 is tight in the female fitting part 5 is adopted in consideration of stability of the connection it is hard to disconnect the male fitting part 6 from the female fitting part 5 and hard to fit the male fitting part 6 into the female fitting part 5. That is, the operability in connecting the connector members C1 and C2 is poor. When a construction in which the male fitting part 6 fits loosely in the female fitting part 5 is adopted in consideration of operability, it is easy to fit the parts together but also easy to disconnect them. That is, the plug terminal 2 and the socket terminal 4 are not stably connected with each other.

In this known connector, to prevent the fitting parts 5 and 6 from being disconnected, a locking rib 7 is formed on the outer peripheral surface of the male fitting part 6 and a locking groove 8 is formed on the inner peripheral surface of the female fitting part 5. The rib 7 and the groove 8 are engaged when the male fitting part 6 is fitted into the female fitting part 5.

The connector alternatively has a plurality of the locking ribs 7 and a plurality of the locking grooves 8 formed axially continuously in the shape of wave in section on the fitting parts 5 and 6.

The rib 7 and the groove 8 allow the male fitting part 6 to be loosely fitted into the female fitting part 5, but the locking rib 7 gives rise to a large fitting resistance. Thus, the fitting operation in this construction is not substantially different from the operation of press fitting the male fitting part 6 into the female fitting part 5 in a construction having neither locking rib 7 nor locking groove 8

SUMMARY OF THE INVENTION

This invention avoids or reduces the above-described problems. Therefore, this invention provides an electrical connector in which a male fitting part can be fitted easily into a female fitting part while they are prevented from being easily disconnected from each other. This allows a connection operation to be performed with high efficiency, and allows the terminals to be connected stably with each other.

According to the invention there is provided an electrical connector including a first connector member having a first housing and a first terminal accommodated in the first housing, and a second connector member having a second housing and a second terminal accommodated in the second housing.

The first housing has a female fitting part having an interior fitting surface and an open front end and the second housing has a male fitting part having an exterior fitting surface and a front end. The male fitting part is adapted to fit into the female fitting part, with the exterior fitting surface of the male fitting part contacting the interior fitting surface of the female fitting part when the first and second connector members are brought together into a connected state of the connector in which the first terminal and the second terminal are engaged to effect electrical connection.

The male fitting part has on its exterior fitting surface a first locking element and the female fitting part has on its interior fitting surface a second locking element. The first and second locking elements are adapted to engage when the connector is in the connected state so as to restrain the male and female fitting parts from disconnection.

The female fitting part has a front portion which includes the open front end and the second locking element and is formed of elastic material so as to be resiliently expansible. The male fitting part is made of material of lower elasticity than the front portion of the female fitting part, whereby the male fitting part is less deformed than the female fitting part when they are fitted together.

The female fitting part has a second portion located rearwardly with respect to the front portion and providing part of the interior surface of the female fitting part. The second portion has a lower elasticity than the front portion.

In one exemplary construction of the invention, when the male fitting part fits into the female fitting part, the front portion of the female fitting part expands elastically, thus relieving the fitting resistance of the locking elements and allowing easy receipt of the male fitting part. Accordingly, the construction allows the fitting resistance to be small.

After the male fitting part is fully received, the female fitting part returns to its original shape, or near to its original shape, due to its elasticity. Thus, the fitting state can be reliably maintained by the locking operation of the locking elements. The disconnection force required can be greater than the connection force, due to the shape of the locking elements.

Owing to the action of the construction, it is possible to satisfy the apparently opposite demands of ease of fitting the male fitting part into the female fitting part and difficulty in disconnecting them from each other.

The first locking element may be a locking projection on the exterior surface of the male fitting part and the second locking element may be a locking recess in the interior surface of the female fitting part, and the female fitting part may have at its front end a contact surface located so as to be engaged by the locking projection when the male fitting part is inserted into the female fitting part so as to provide resistance to the insertion.

In this case, in the fitting operation:

(1) The locking projection portion collides with the front end of the female fitting part. As a result, an initial fitting resistance is generated.

(2) When the locking projection portion is forced forward against the initial resistance, the front portion of the female fitting part expands outward elastically, with a small resistance being applied thereto.

(3) When the locking projection portion is locked into the locking recess, the front portion of the female fitting part contracts, and returns to its original shape, or near to its original shape.

In a series of the above operations (1) to (3), an operator presses one connector member with a comparatively large force to advance the locking projection toward the locking recess after the locking projection first contacts the front end of the female fitting part. As a result, the locking projection advances to the locking recess portion with an inertial effect and is locked into the locking recess portion. At this time, the construction may be such that operator senses the completion of fitting, e.g. as a "click". The operator thus knows that the fitting operation is complete. The inertial effect minimizes the risk of an imperfect connection.

As described above, the front portion of the female fitting part expands elastically, and the second portion rearward of the front portion is undeformable or relatively hard to deform. Thus, when an external force (in particular, a bending load) is applied to the female fitting part after the connection between the connector members is completed, the second portion protects the terminal connection. Thus, there is no possibility that the terminal connection is placed out of position, deformed or connected defectively due to an external force.

These and other features and advantages of this invention are described in or are apparent from the following description of various exemplary embodiments.

BRIEF DESCRIPTION OF THE DRAWINGS

An embodiment of the invention will now be described by way of non-limitative example with reference to the accompanying drawings, in which.

DETAILED DESCRIPTION OF EXEMPLARY EMBODIMENTS

Various exemplary embodiments of this invention will be described below with reference to FIGS. 1 to 6.

Figure 1:
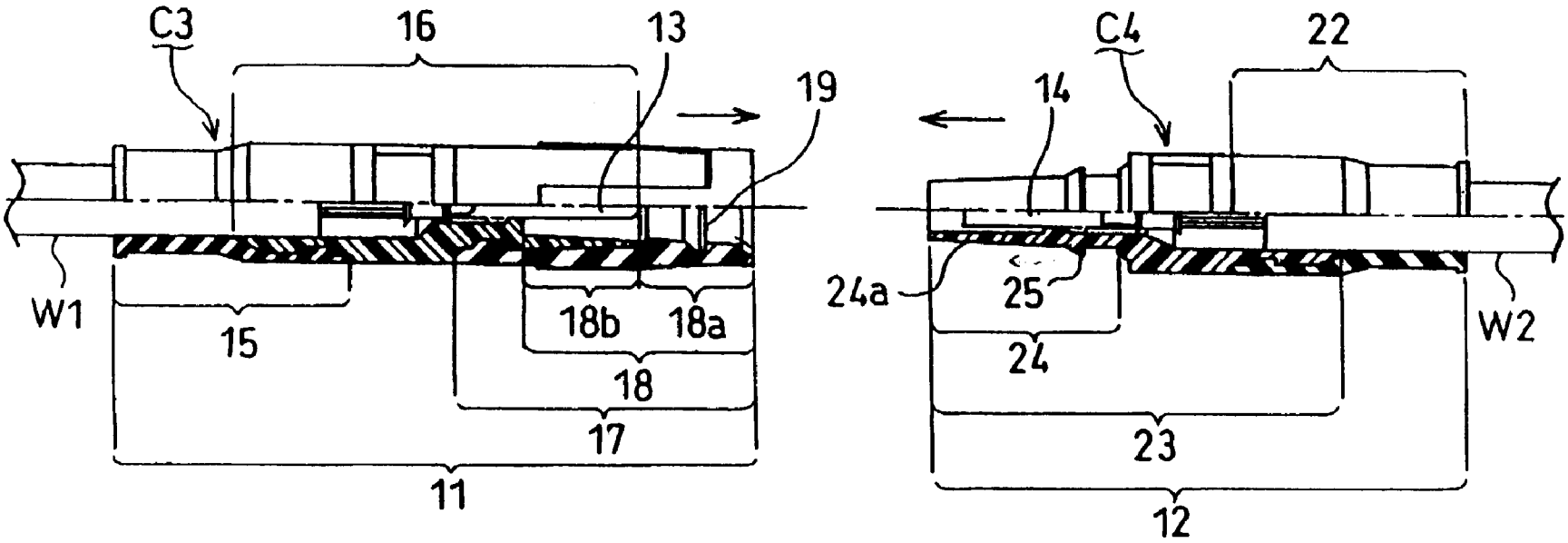
FIG. 1 is a front view, half in section, of a connector embodying this invention in a state before a plug-side connector member and a socket-side connector member are connected with each other.
Figure 2:
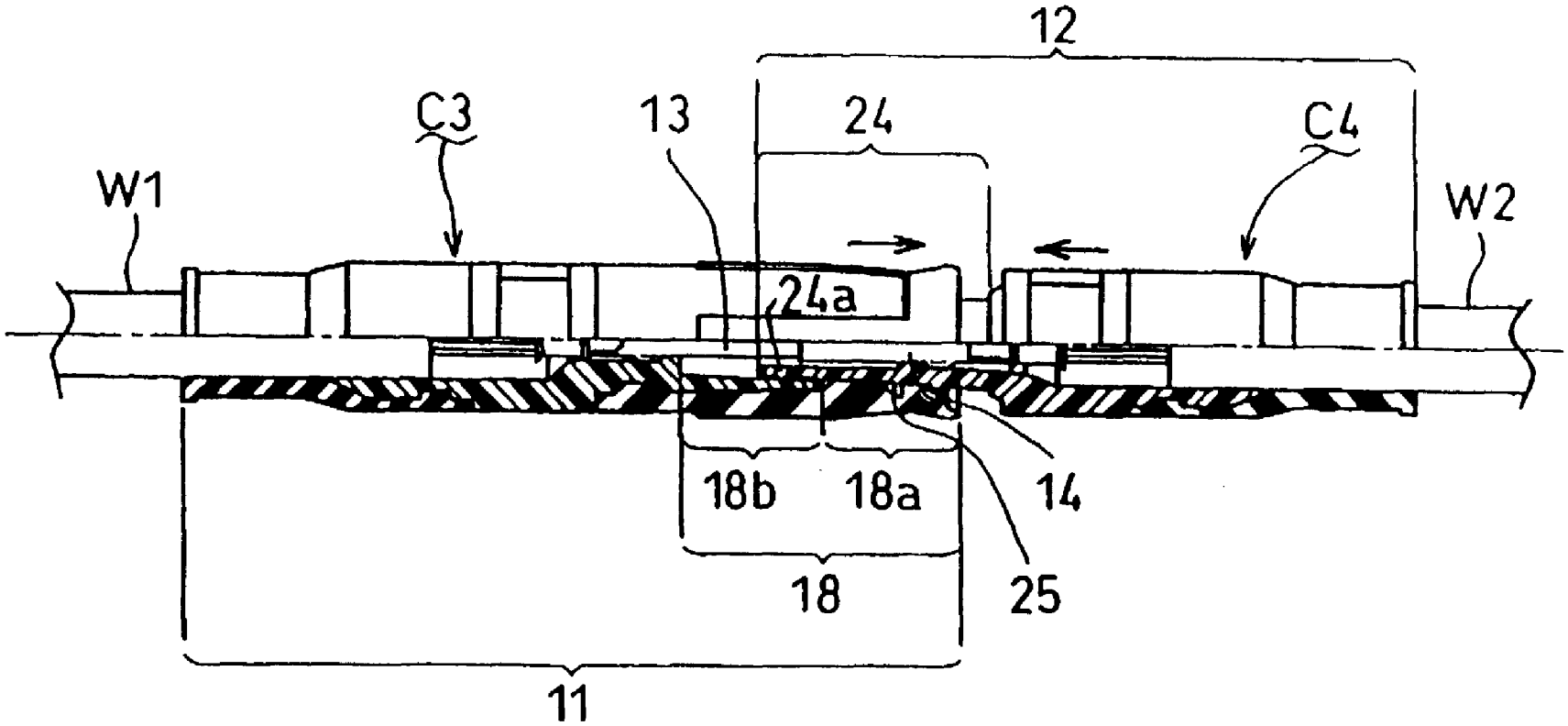
FIG. 2 is a front view, half in section, of the connector members shown in FIG. 1 just before they are fully connected with each other.
Figure 3:
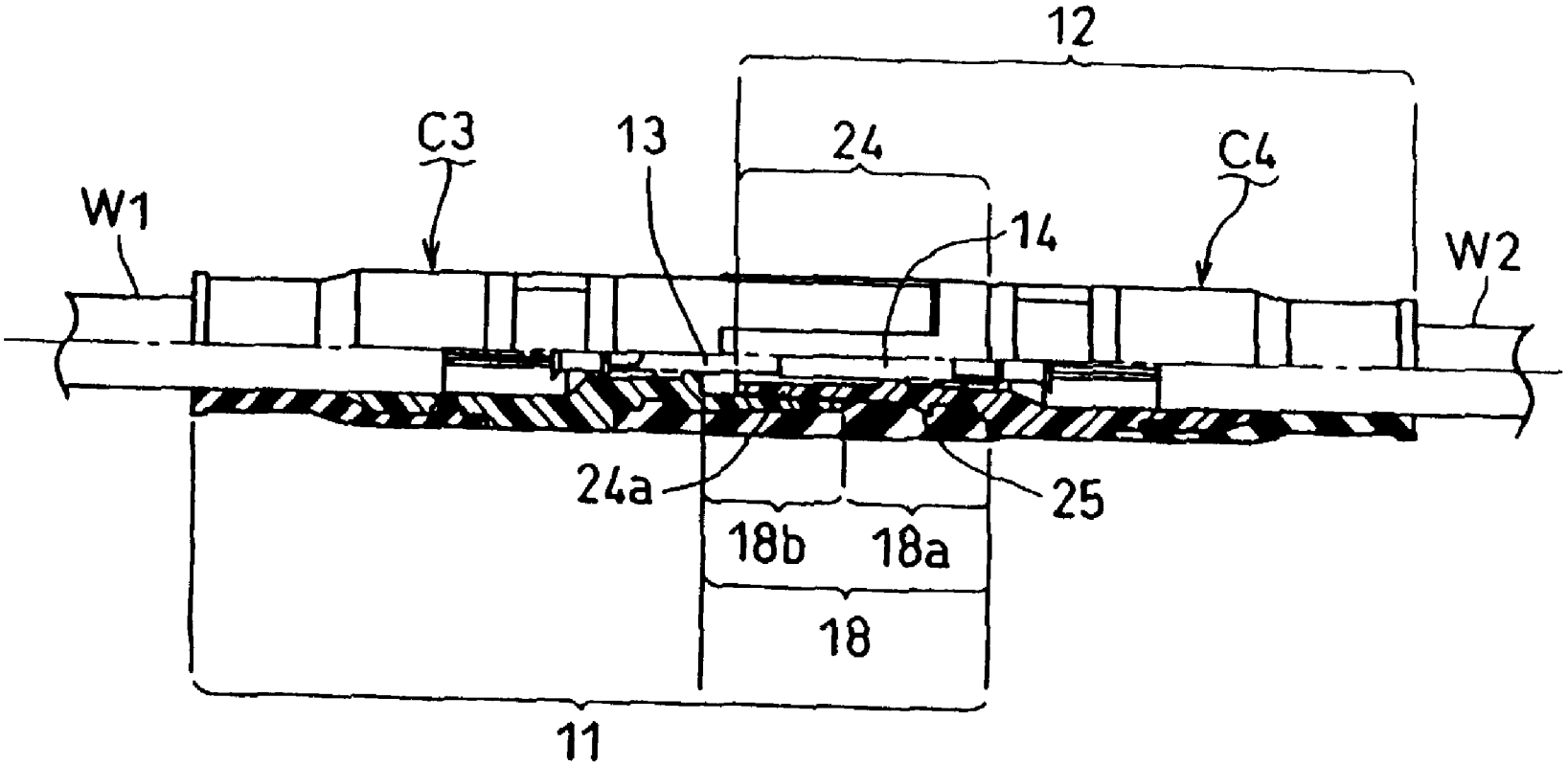
FIG. 3 is a front view, half in section, of the connector members shown in FIG. 1 connected with each other.

In FIG. 1, an electrical connector includes a plug-side connector member C3 having a housing 11 accommodating a male terminal 13, and a socket-side connector member C4 having a housing 12 accommodating a female terminal 14.

The housing 11 of the plug-side connector member C3 and the housing 12 of the socket-side connector member C4 may be cylindrical, or any other desired or practical shape, such as square, rectangular, triangular, hexagonal, octagonal or the like in section, or any combination thereof. The housing 11 of the plug-side connector member C3 includes a first molded part 15, a second molded part 16, and a third molded part 17, which are formed separately and joined together. The first part 15 is at a rear side of the housing 11 where an electric wire W1 projects, the third part 17 is at a front side of the housing 11, and the second part 16 is between the first part 15 and the third part 17. The first part 15 and the second part 16 are fitted together and non-removably connected with each other and the second part 16 and the third part 17 are fitted together and non-removably connected with each other to form the housing 11 of the plug-side connector member C3.

The first part 15 located at the rear side of the housing 11 seals the housing 11 to the electric wire WI and is made of an elastic material such as rubber. The first part 15 is in close contact with the peripheral surface of the electric wire W1 to make the member C3 water-proof.

The third part 17 is also made of a resiliently deformable material such as rubber, preferably a rubber, such as silicone rubber, which does not suffer "creep" when subjected to stress.

The second part 16 is formed of a relatively rigid synthetic plastic material, such as modified PPE (polyphenylene ether), modified PPO (polyphenylene oxide), PPS (polyphenylene sulfide), UP (unsaturated polyester) or the like, which can be suitably used in a connector to constitute a part of a solar-energy power generation system. These plastic materials are weather resistant, hydrolysis resistant, fire-retardant, comparatively hard, and have a low degree of elasticity. In normal use, the third part 17 is not deformed, or is deformed very little.

A female fitting part 18 of the connector member C3 is formed of the third part 17 and a front portion of the second part 16 that overlaps the third part 17. Thus the female fitting part 18 has an elastically expandable/contractible portion 18*a* formed of elastic material and located at its front side, and a less deformable or undeformable portion 18*b* formed of a material which is harder than the expandable/contractible portion 18*a* and difficult to elastically deform located at its rear side. A male terminal 13 is located in this female fitting part 18.

To simplify the drawings, the reference numerals 15, 16 and 17 of the first, second and third parts are not shown in FIGS. 2 to 6.

A locking groove 19 is formed around part or all of the inner peripheral surface of an intermediate portion of the expandable/contractible portion 18*a*. As shown enlarged in FIGS. 4 to 6, the groove 19 may be approximately V-shaped in section, and its surface at its front side is formed perpendicularly, or at an angle close to perpendicular, to the central axis of the connector.

A resistance locking surface 20 (see FIGS. 4 to 6) perpendicular, or at an angle close to perpendicular, to the central axis is formed on the inner peripheral surface of the front end of the expandable/contractible portion 18*a*. A guide surface 21 tapering outward towards the front end is formed at an outer peripheral edge of the resistance locking surface 20.

The housing 12 of the socket-side connector member C4 is formed of a first part 22, which seals the housing 12 to an electric wire W2, located at a rear side of the housing 12 from which the electric wire W2 projects, and a second part 23 located at a front side of the housing 12. The first part 22 and the second part 23 are fitted together and non-separably connected with each other to form the housing 12. A male fitting part 24 is formed at a front portion of the second part 23, and houses a female terminal 14.

The first part 22 is made of an elastic material such as rubber or the like to cause the housing 12 to be waterproof. To allow the male fitting part 24 to be sufficiently rigid as to be smoothly inserted into the female fitting part 18 of the connector member C3, the second part 23, similarly to the second part 16 of the plug-side connector member C3, is formed of a synthetic plastic material such as PVC or modified PPE. PVC or modified PPE allows the connector to constitute a part of a solar-energy power generation system, is comparatively hard, and has a low degree of elasticity. In normal use of the connector, the part 24 is substantially not deformed.

To simplify the drawings, the reference numerals 22 and 23 of the first and second parts are not shown in FIGS. 2 to 6.

A locking rib 25 that engages in the locking groove 19 of the female fitting part 18 is formed on the outer peripheral surface of the male fitting part 24 close to a rear end of the male fitting part 24.

In correspondence to the shape of the groove 19, the rib 25 is, for example, V-shaped in section, and a surface at the rear side of the rib 25 is formed perpendicularly, or at an angle close to perpendicular, to the central axis, while a forward-facing surface of the rib 25 slopes more gently.

A maximum outer diameter of the rib 25 is equal to or a little larger than a maximum outer diameter of the groove 19.

A forward-facing stepped annular surface 26 (see FIGS. 4 to 6) is formed at the rear end of the male fitting part 24 of the housing 12. When the male fitting part 24 of the housing 12 is inserted fully into the female fitting part 18 of the housing 11, the resistance locking surface 20 and the guide surface 21 of the female fitting part 18 contact the stepped surface 26.

An external peripheral surface 24*a* of the male fitting part 24 is formed tapering towards its front end so that the male fitting part 24 can easily fit into the female fitting part 18. The outer diameter of the male fitting part 24 at its front end is set a little smaller than the inner diameter of the female fitting part 18.

To allow the female fitting part 18 and the male fitting part 24 to contact closely when fitted, the diameter of the male fitting part 24 at its rear end is set equal to or a little larger than the inner diameter of the female fitting part 18. This achieves a seal.

Figure 4:
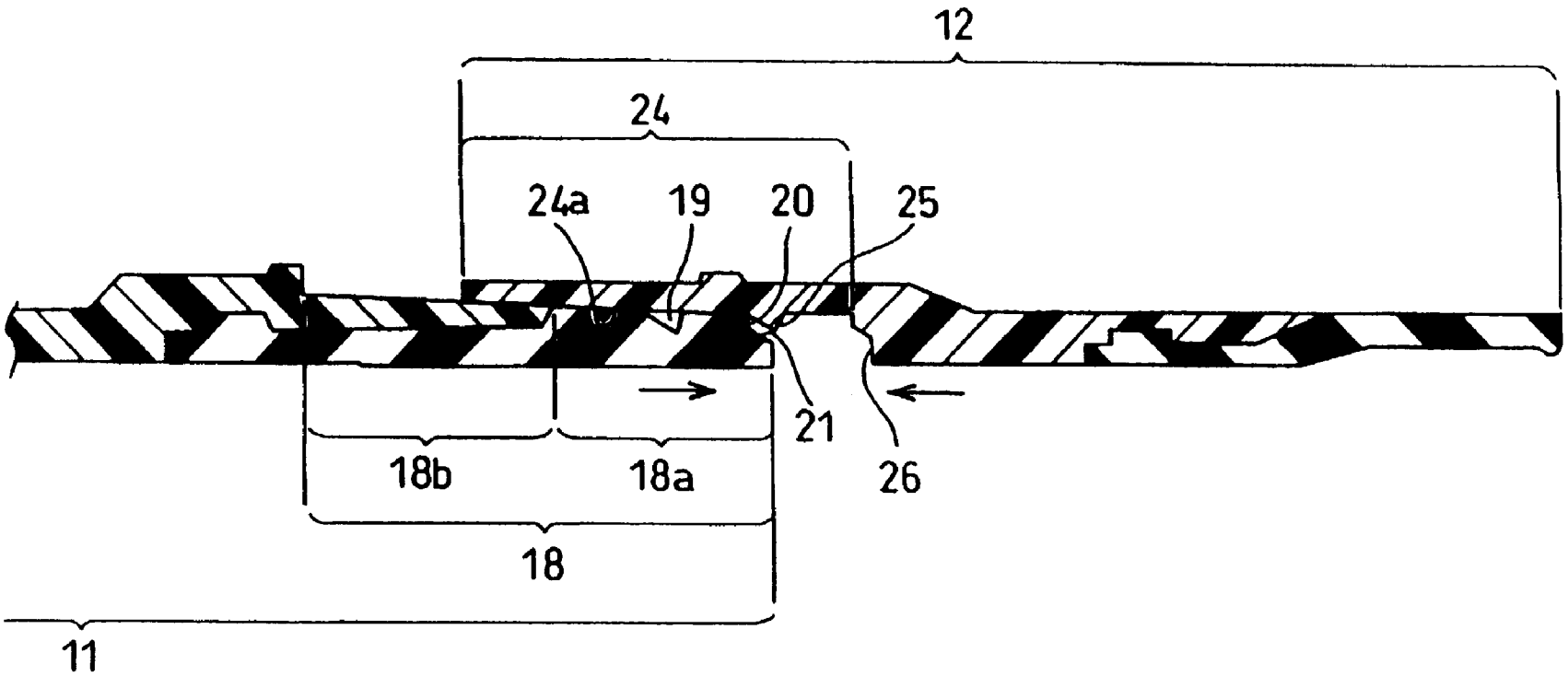
FIG. 4 is an enlarged partial view of a state of the connector members immediately before the state shown in FIG. 2.
Figure 5:
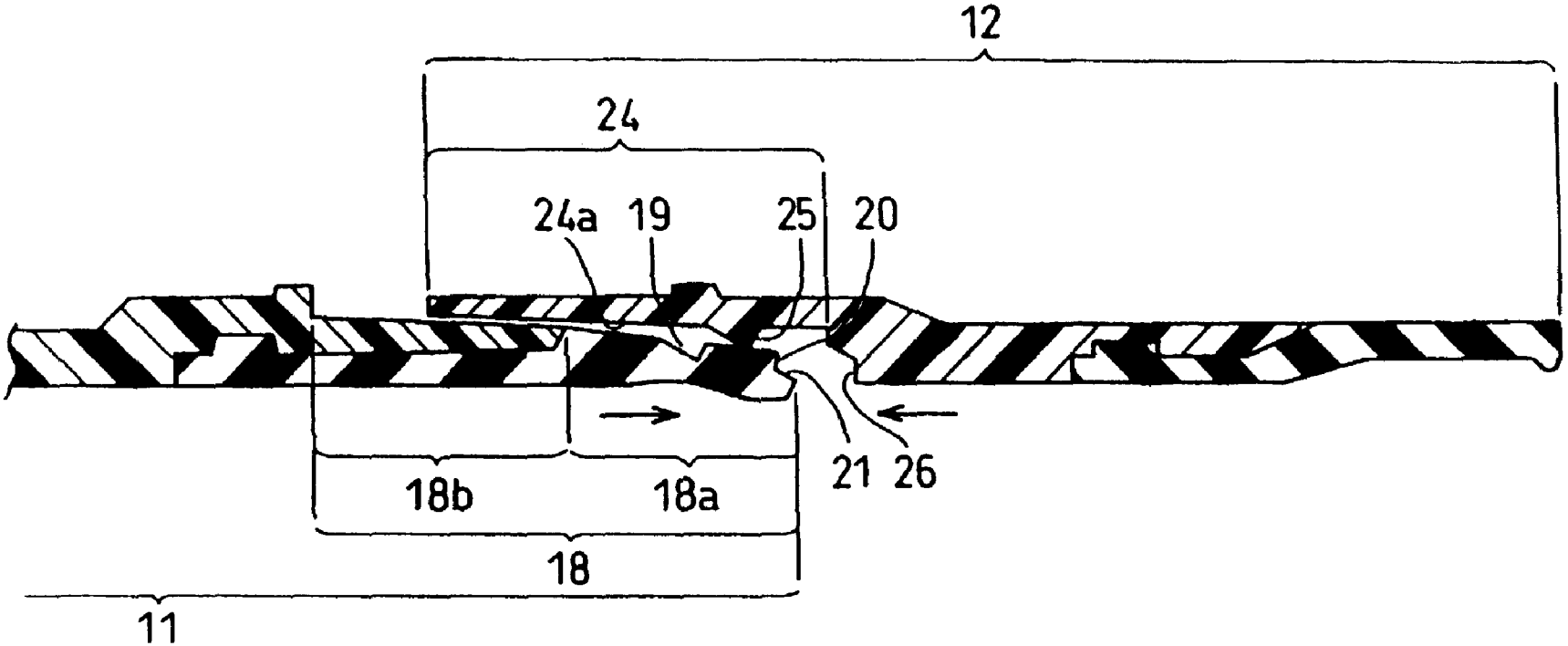
FIG. 5 is an enlarged partial view of the state shown in FIG. 2.

In connecting the connector members C3 and C4 with each other, the following actions occur:

(1) As shown in FIG. 4, the locking rib 25 engages the resistance locking surface 20. As a result, a resistance to fitting is generated.

(2) When the rib 25 is pressed toward the female fitting part 18 against this fitting resistance, the expandable/contractible portion 18*a* of the female fitting part 18 expands outward elastically, thus receiving the rib 25. As a result, the rib 25 advances, with a small resistance being applied thereto.

(3) When the rib 25 is locked into the groove 19, the expandable/contractible portion 18*a* returns to its original shape, or nearly so.

In the operation of connecting the connector members C3 and C4 with each other, the operator presses the members together with a comparatively large force when the locking rib 25 collides with the resistance locking surface 20. As a result, the expandable/contractible portion 18*a* expands outward. At this time, the male fitting part 24 becomes fully fitted in the female fitting part 18 owing to the inertia generated in overcoming the resistance between the locking rib 25 and the resistance locking surface 20. Consequently, the advance of the locking projection portion 25 is stopped at the correct position, which is the fully engaged position, rather than being stopped at a partially engaged position.

That is, after the locking rib 25 passes the resistance locking surface 20, the male fitting part 24 is capable of fitting into the female fitting part 18 securely by applying a small force to the locking rib 25. There is very low possibility that the male fitting part 24 will not be fitted correctly into the female fitting part 18.

In an exemplary connection operation, the advance of the locking rib 25 is stopped, and then the locking rib 25 again advances and is locked into the locking groove 19, thus generating a "click". At this time, the advance of the rib 25 stops again and the operator senses the "click", which allows the operator to know that the connection between the plug-side connector member C3 and the socket-side connector member C4 has been completed.

Figure 6:
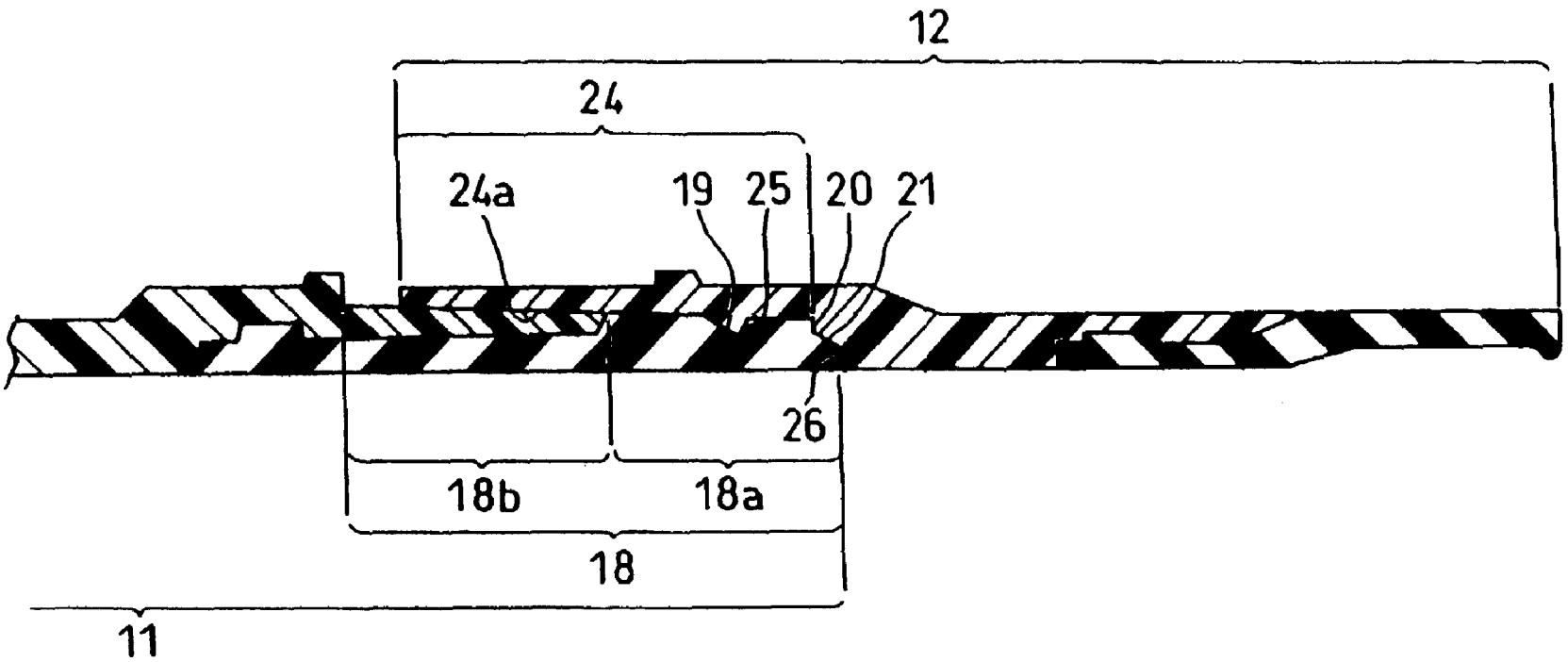
FIG. 6 is an enlarged partial view of the state shown in FIG. 3.
Figure 7:
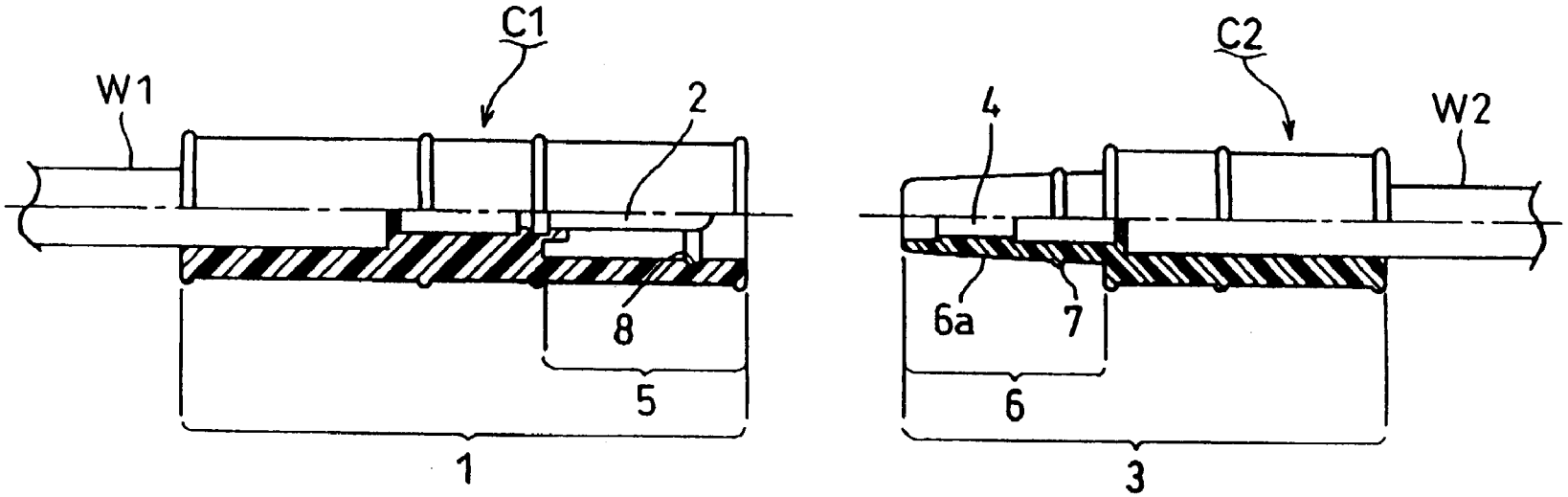
FIG. 7 (PRIOR ART)
FIG. 7 is a front view, half in section, of a known connector described above in a state before a plug-side connector member and a socket-side connector member are connected with each other.
Figure 8:
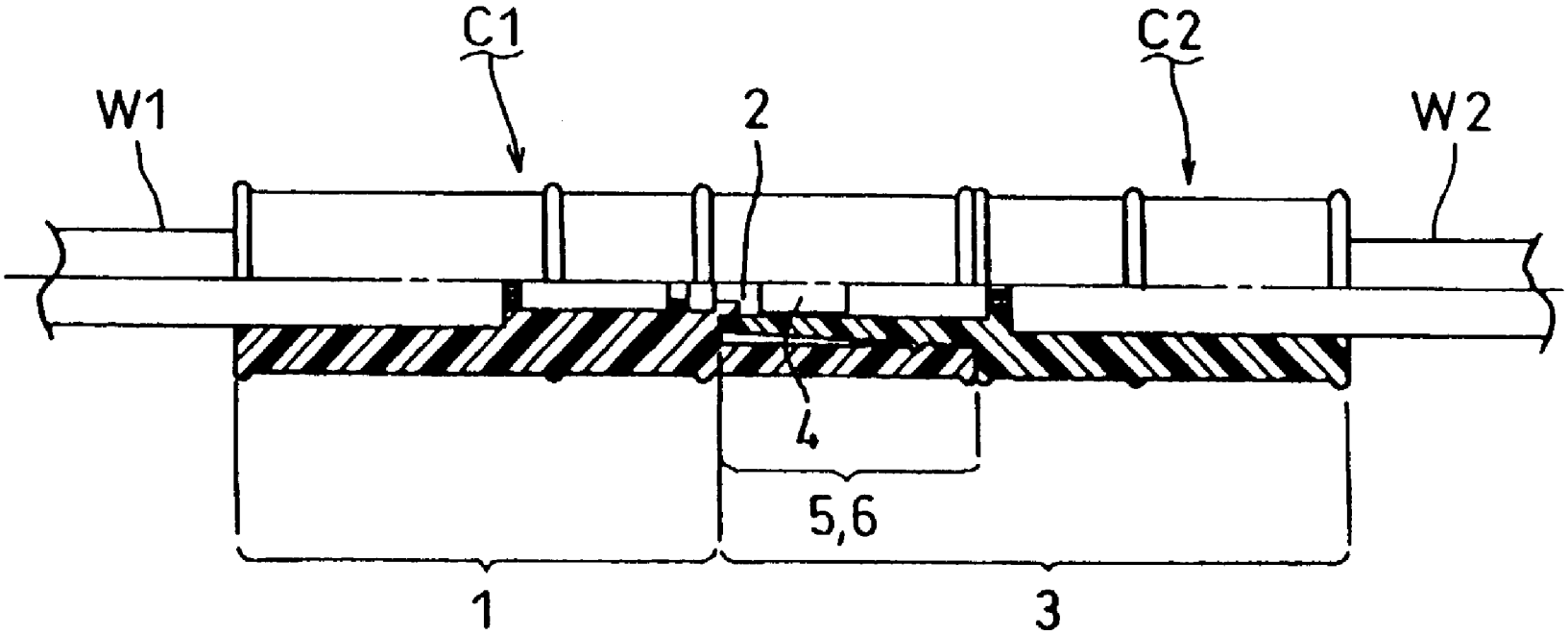
FIG. 8 (PRIOR ART)
FIG. 8 is a front view, half in section, of the connector members shown in FIG. 7 connected with each other.

Referring to FIG. 6, when the male fitting part 24 fits into the female fitting part 18, the resistance locking surface 20 and the fitting guide surface 21 contact the stepped surface 26, and the external peripheral surface of the male fitting part 24 and the internal surface of the female fitting part 18 become flush and in continuous contact with each other. This state allows the operator to recognize the completion of the connection between the plug-side connector member C3 and the socket side connector member C4.

The guide surface 21 guides the locking rib 25 toward the inside of the female fitting part 18 during the fitting operation.

The female fitting part 18 is not deformed entirely; only the front portion, which is the expandable/contractible portion 18*a* including the groove 19, is elastically deformed. The rear portion, which is the less deformable or undeformable portion 18*b*, is undeformed, or deformed only slightly compared to the expandable/contractible portion 18*a*. Thus, when an external force is applied to the female fitting part 18 after the connection between the connector members C3 and C4 is completed, the less deformable or undeformable portion 18*b* protects the terminal connection region. Thus, there is low risk that the terminal connection region is placed out of position, deformed or connected defectively by an external force.

In the above-described embodiment, the locking recess 19 is formed in the female fitting part 18 as a locking portion, and the locking projection 25 is formed on the male fitting part 24 as a locking portion. However, the locking projection portion 25 may be formed on the inner peripheral surface of the female fitting part 18, and the locking recess 19 may be formed on the peripheral surface of the male fitting part 24.

Further, a plurality of locking projections 25 and locking recesses 19 may be formed at a plurality of positions spaced at appropriate axial intervals, or formed continuously in the shape of a wave.

Furthermore, in the above-described embodiment, only the expandable/contractible portion 18*a* of the female fitting part 18 is constructed as an elastically deformable part. However, the entire female fitting part 18 may be formed as an elastically deformable part.

The electrical connector of this invention can be used, for example, for electric connection between modules of a solar battery panel and between solar battery panels. The electrical connector of this invention can also be used widely for connections of other electric components. Furthermore, the illustrated connector is single-pole, but the invention is also applicable to multi-pole connectors.

Figure 9:
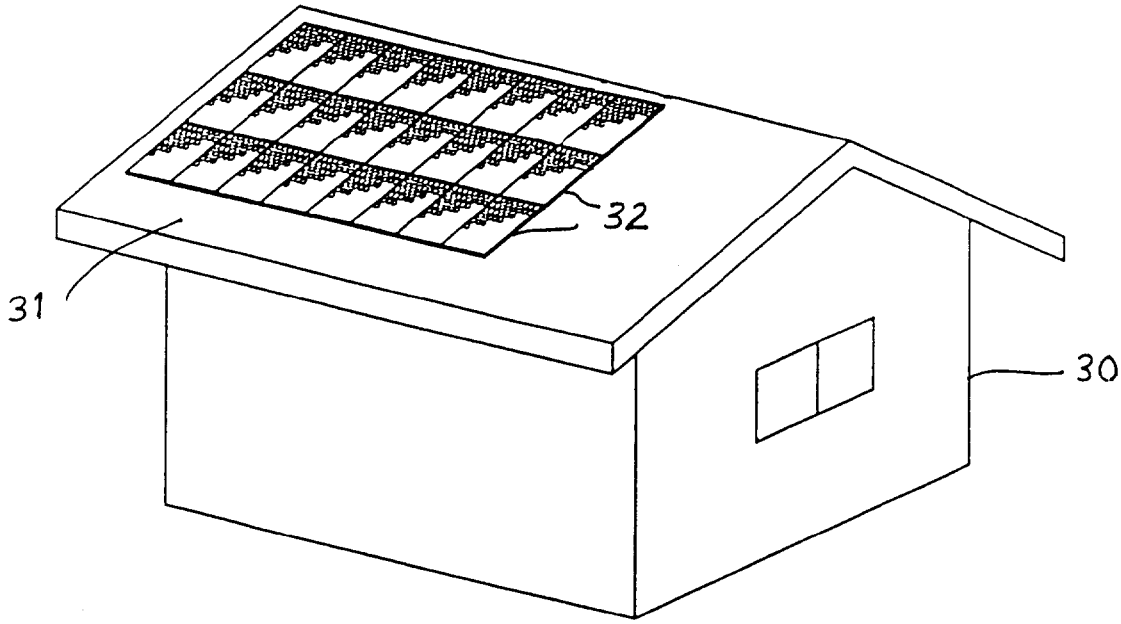
FIG. 9 is a diagrammatic view of a building having an array of solar panels with which the connector of this invention may be employed.
Figure 10:
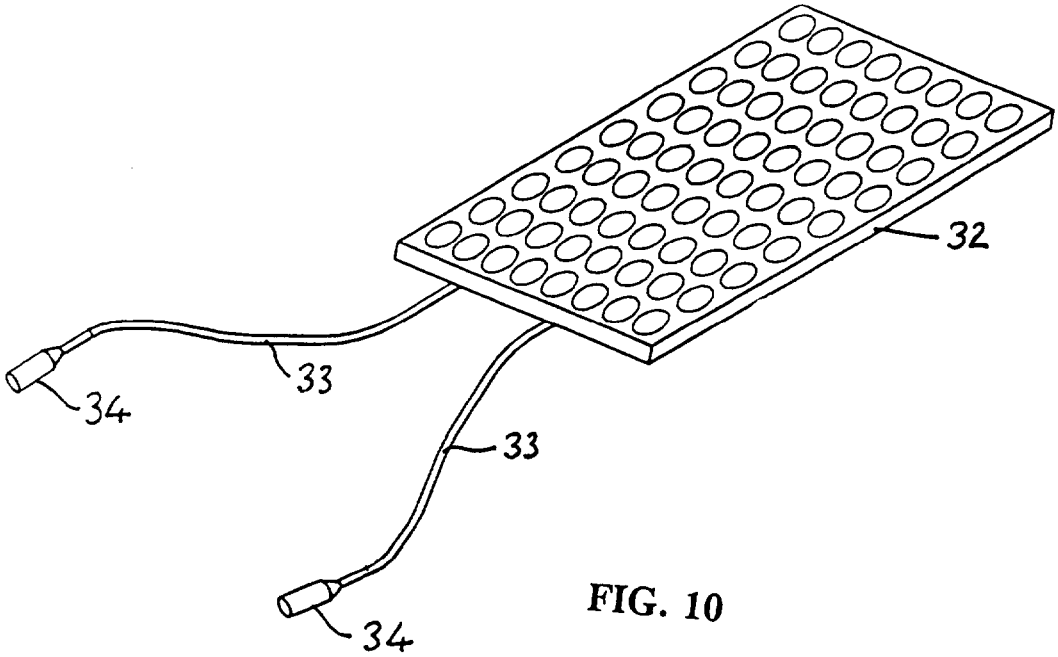
FIG. 10 is a view of a solar panel including connector members of this invention.

FIG. 9 shows a building 30 having a roof 31 whose exterior face is partly composed of an array of solar panels 32. The solar panels 32 are electrically interconnected, e.g. in series, by connectors of the invention such as shown in FIGS. 1 to 6. FIG. 10 shows one solar panel 32 having electrical wires 33 connected into connector members 34. These connector members 34 may both be plug-side members C3 of FIGS. 1 to 6, or both socket-side members C4, or one may be a plug-side member C3 and the other a socket-side member C4. Such connectors may also be used for connecting solar panels to exterior circuits. The connector is compact, strong and easy to connect correctly in the confined spaces present in, for example, a roof.

While the invention has been described in conjunction with the exemplary embodiments described above, many equivalent alterations, modifications and variations will become apparent to those skilled in the art once given this disclosure. Accordingly, the exemplary embodiments of the invention as set forth above are considered to be illustrative and not limiting. Various changes to the described embodiments may be made without departing from the spirit and scope of the invention.

What is claimed is:

1. An electrical connector comprising:

a first housing accommodating a first terminal, a second housing accommodating a second terminal, said first housing having a female fitting part having an interior fitting surface and an open front end and said second housing having a male fitting part having an exterior fitting surface and a front end, said male fitting part fitting into said female fitting part with contact between said interior and exterior fitting surfaces when said first housing and said second housing are brought together into a connected state of said connector in which said first terminal and said second terminal are electrically engaged, said male fitting part having on said exterior fitting surface a first locking element and said female fitting part having on said interior fitting surface a second locking element, said first and second locking elements engaging when said connector is in said connected state so as to restrain said male and female fitting parts from disconnection, wherein said female fitting part has a front portion that includes said open front end and said second locking element and is formed of a first material, and said male fitting part is made of a second material, different from said first material, the second material having a lower elasticity than said first material, whereby said male fitting part is less deformed than said female fitting part when the male fitting part and the female fitting part are fitted together, and said female fitting part has a second portion, made of a third material, different from said first material, the third material having a lower elasticity than said first material, located rearwardly with respect to said front portion and providing part of said interior surface.

2. An electrical connector according to claim 1, wherein said first locking element is a locking projection on one of said exterior surface of said male fitting part and said interior surface of said female fitting part, and said second locking element is a locking recess in the other of said exterior surface of said male fitting part and said interior surface of said female fitting part, and said female fitting part has a front end surface including a contact surface that engages said locking projection when said male fitting part is inserted into said female fitting part so as to provide resistance to the insertion.

3. An electrical connector according to claim 2, wherein said locking projection has a first surface that faces forwardly in a direction of insertion of the male fitting part into the female fitting part and is inclined to said direction of insertion, and a second rearwardly facing surface which is located rearwardly of said first surface and is inclined more closely than said first surface to a plane perpendicular to said direction of insertion.

4. An electrical connector according to claim 1, wherein said male fitting part tapers towards said front end, and said interior fitting surface of said female fitting part complementarily tapers away from said open front end.

5. An electrical connector according to claim 1, wherein said first terminal is located in a recess of said first housing bounded by said interior fitting surface, and said second terminal is located in a recess in said male fitting part which opens at said front end.

6. An assembly of solar panels having at least one electrical connector according to claim 1 that electrically inter-connects the solar panels.

7. An electrical connector according to claim 1, further comprising at least one of:

a first seal part, made of rubber material, connected to a rear end of the second portion of the female fitting part; and a second seal part, made of rubber material, connected to a rear end of said male fitting part.

8. An electrical connector according to claim 1, wherein said first and second housings are water-proof.

9. An electrical connector according to claim 1, wherein said second material comprises plastic material.

10. An electrical connector according to claim 9, wherein said plastic material comprises at least one of modified polyphenylene ether (PPE), modified polyphenylene oxide (PPO), polyphenylene sulfide (PPS), unsaturated polyester (UP), and polyvinyl chloride (PVC).

11. An electrical connector according to claim 1, wherein said first material comprises rubber material.

12. An electrical connector according to claim 11, wherein said rubber material comprises silicone rubber.

13. An electrical connector according to claim 2, wherein the surface that contacts said locking projection comprises a resistance surface portion formed substantially perpendicular to a longitudinal axis of the connector.

14. An electrical connector according to claim 13, wherein the surface that contacts said locking projection further comprises a guide surface portion that tapers outward towards said open front end.

15. An electrical connector according to claim 1, wherein the second material is the same as the third material.

* * * * *